US008351833B2

(12) United States Patent
Koshida

(10) Patent No.: US 8,351,833 B2
(45) Date of Patent: Jan. 8, 2013

(54) IMAGE HEATING APPARATUS

(75) Inventor: Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 259 days.

(21) Appl. No.: 12/891,055

(22) Filed: Sep. 27, 2010

(65) Prior Publication Data

US 2011/0076070 A1 Mar. 31, 2011

(30) Foreign Application Priority Data

Sep. 28, 2009 (JP) ..... 2009-222319

(51) Int. Cl.
*G03G 15/20* (2006.01)

(52) U.S. Cl. ..... 399/328

(58) Field of Classification Search ..... 399/328, 399/322, 323, 406; 219/619, 216, 469–471
See application file for complete search history.

(56) References Cited

U.S. PATENT DOCUMENTS 3,857,189 A * 12/1974 Katayama et al. ..... 219/216
3,941,471 A * 3/1976 Schatka et al. ..... 219/216
4,075,456 A * 2/1978 Sakamaki et al. ..... 219/216
4,668,073 A * 5/1987 Hatabe et al. ..... 219/216
4,733,272 A * 3/1988 Howe et al. ..... 219/216
5,390,006 A * 2/1995 Wakabayashi et al. ..... 219/216
5,475,788 A * 12/1995 Classens et al. ..... 219/216
5,890,032 A * 3/1999 Aslam et al.
6,684,037 B2 * 1/2004 Tamaoki ..... 219/216
7,609,991 B2 10/2009 Koshida
7,962,083 B2 * 6/2011 Takahashi ..... 399/328
7,962,084 B2 * 6/2011 Tanaka et al.
7,970,330 B2 * 6/2011 Condello et al. ..... 399/323
2007/0059010 A1 * 3/2007 Arimoto et al.
2010/0178088 A1 7/2010 Koshida et al.
2012/0155918 A1 * 6/2012 Egi

FOREIGN PATENT DOCUMENTS

JP 2001-194940 7/2001

* cited by examiner

*Primary Examiner* — Susan Lee
(74) *Attorney, Agent, or Firm* — Fitzpatrick, Cella, Harper & Scinto

(57) ABSTRACT

An image heating apparatus includes an excitation coil; an image heating member for heating an image on a recording material by heat generated by a magnetic flux of the excitation coil; a core disposed opposed to the coil; a moving device for moving the core between a first position in which the core is opposed to the excitation coil and a second position in which the core is remoter from the excitation coil than the first position; and an air blower for blowing air into a space between the core and the excitation coil, the space being provided by moving the core to the second position.

5 Claims, 10 Drawing Sheets

(a)

(b)

(a)

(b)

IMAGE HEATING APPARATUS

FIELD OF THE INVENTION AND RELATED ART

The present invention relates to an image heating apparatus of the electromagnetic induction type, which is ideal as an image heating apparatus to be mounted in an image forming apparatus, such as a copying machine, a printer, a facsimile, and a multifunction apparatus capable of performing as a combination of two or more of the preceding apparatuses, which forms images with the use of one of the electrophotographic, electrostatic, and magnetic image formation processes, and the like.

In the field of an image forming apparatus such as those mentioned above, a heating apparatus of the electromagnetic induction type has come to be widely used as an image heating apparatus for heating an unfixed a toner image on a recording medium. This apparatus has an image heating member and a pressure applying member, such as an endless belt and a roller, respectively, which are rotated together while being pressed upon each other, forming thereby a compression nip (nip). As a sheet of a recording medium on which an unfixed toner image is present is fed into the image heating apparatus, the apparatus applies heat and pressure while conveying the sheet of the recording medium through the nip. Thus, while the sheet of the recording medium is conveyed through the nip, the toner image is thermally fixed to the recording medium. One of the means proposed for heating the image heating member of the fixing apparatus is to generate Joule heat in the image heating member in the fixation roller by the magnetic field generated by an exciter coil as the means for heating the image heating member. One of the characteristics of this method is that it makes it possible to place the heat source very close to the toner. Therefore, compared to any of the conventional methods, which use a halogen lamp, it takes less time for the surface temperature of the image heating member to reach its target level (proper level of fixation) right after the fixing apparatus is turned on. It also has a simple and short heat conduction path from the heat source to the toner, and therefore, is higher in thermal efficiency. However, image heating apparatuses such as the above-described one suffer from the following problems in a case where a substantial number of small sheets of a recording medium are continuously conveyed through them for fixation. That is, heat is transmitted to each sheet of the recording medium from the surface of the portion (sheet path portion) of the image heating member, which is in contact with a sheet of the recording medium, whereas heat is not transmitted from the portions of the surface of the image heating member, which are not in contact with a sheet of the recording medium. Therefore, heat accumulates in these portions of the image heating member, creating a substantial difference in temperature between the portion of the image heating member that comes in to contact with a sheet of the recording medium one after another, and the portions of the image heating roller that do not come into contact with a sheet of the recording medium. Ordinarily, only the temperature of the sheet path portion of the image heating member is controlled so that its surface temperature remains at a preset level. Therefore, the out-of-sheet-path portions of the image heating member excessively increase in temperature (this phenomenon hereafter will be referred to as "out-of-sheet-path temperature increase). It is not this excessive amount of heat alone to which the coating of the coil, which is a part of the magnetic flux generating means, is subjected. That is, it is also the heat generated by the surface effect of the coil, and the heat generated therein by the hysteresis loss of the magnetic core. Thus, a highly heat resistant resin is necessary as the material for the coating of the coil, which tends to restrict the image forming apparatus in design. Further, it sometimes occurs that because the core temperature exceeds the Curie temperature, the value of which is specific to each core, the core becomes nonmagnetic. One of the solutions to this problem is disclosed in Japanese Laid-open Patent Application 2001-194940. According to the technology disclosed in this application, the core is made up of multiple sections which align in a direction perpendicular to the recoding-medium conveyance direction. Each section can be moved away from the exciter coil by a core section moving means. As a section of the core is moved away from the exciter coil, the distance between the exciter coil and the section of the core increases, and therefore, the magnetic circuit formed, in the adjacencies of the core, of the core and the image heating member decreases in efficiency, which results in the reduction in the amount of heat generated. In other words, the problem that the out-of-sheet-path portions of the image heating member excessively increase in temperature can be prevent by the above-described method, and therefore, the problem that the core and exciter coil excessively increase in temperature can be prevented by the above-described method.

However, in recent years, image forming apparatuses have been substantially increased in productivity, which in turn has made it necessary for the sheet path portion of the image heating member to be supplied with a greater amount of heat. Thus, it has become even more important to prevent the out-of-sheet-path portions of the image heating member from excessively increasing in temperature.

SUMMARY OF THE INVENTION

Thus, the primary object of the present invention is to provide an image heating apparatus of the electromagnetic induction type, the out-of-sheet-path portions of which do not excessively increase in temperature.

According to an aspect of the present invention, there is provided an image heating apparatus comprising: an excitation coil; an image heating member for heating an image on a recording material by heat generated by a magnetic flux of the excitation coil; a core disposed opposed to the coil; moving means for moving the core between a first position in which the core is opposed to said excitation coil and a second position in which the core is remoter from the excitation coil than the first position; and an air blower for blowing air into a space between the core and the excitation coil, the space being provided by moving the core to the second position.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 2(*b*) is an enlarged sectional view of the fixing apparatus in FIG. 1A, at a plane Y-Y in FIG. 2(*a*).

FIG. 3(*b*) is a block diagram of the control system of the apparatus.

FIG. 5(*b*) is a plan view of the fixing apparatus in FIG. 5(*a*), as seen from the direction indicated by an arrow mark X in FIG. 5(*a*).

FIG. 6(*b*) is a perspective view of the fixing apparatus, as seen from the rear side (recording medium exit side) of the apparatus when all the solenoids of the apparatus are in action.

FIG. 7(*b*) is an enlarged sectional view of the fixing apparatus in FIG. 6(*a*) at a plane indicated by a line Y-Y in FIG. 7(*a*).

DESCRIPTION OF THE PREFERRED EMBODIMENTS

Embodiment 1

<Example of Image Forming Apparatus>

Figure 1A:
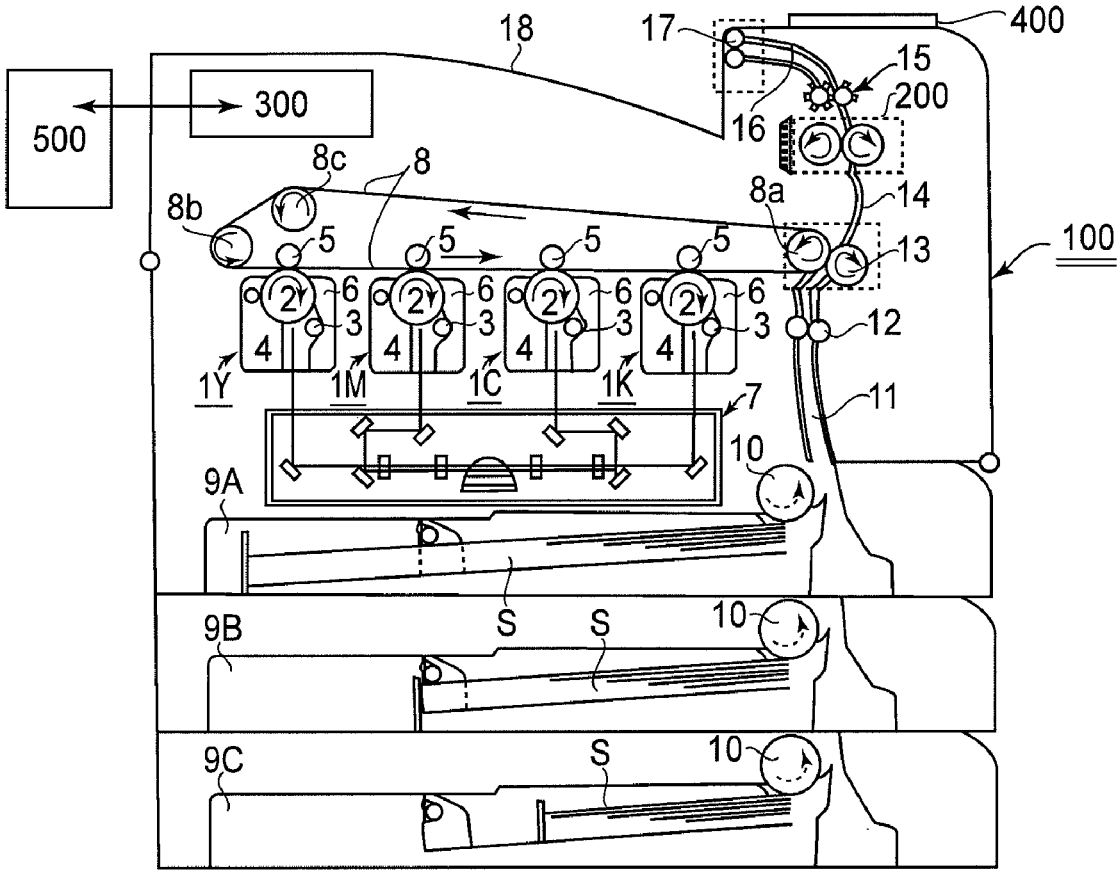
FIG. 1A is a schematic vertical sectional view of the image forming apparatus in the first preferred embodiment of the present invention, and shows the general structure of the apparatus.

FIG. 1A is a schematic vertical sectional view of an electrophotographic color printer 100, which is an example of an image forming apparatus whose fixing apparatus 200 (fixing device) is an image heating apparatus in accordance with the present invention. It shows the general structure of the apparatus. This printer 100 can form full-color copies. More specifically, it forms a full-color image on a sheet of a recording medium in response to the image formation information (image formation data) inputted as digital electric signals from a host apparatus 500, which is connected to the control circuit of the printer 100 so that information can be communicated between the two. The apparatus 500 is a computer, an image reader, etc., for example. The circuit 300 exchanges electrical signals with the apparatus 500 and the control portion 400 (control panel) of the printer. It exchanges electrical signals also with the various image formation devices of the printer 100 to control the image formation sequence of the printer 100. Designated by a reference numeral 8 is the intermediary transfer member of the printer 100, which is in the form of a flexible and endless belt (and therefore will be referred to as intermediary transfer belt 8, hereafter). It is supported and kept stretched by a belt-backing roller 8*a*, a turn roller 8*b*, and a tension roller 8*c*. As the roller 8*a* is driven, the intermediary transfer belt 8 is circularly moved in the counterclockwise direction indicated by an arrow mark at a preset speed. Designated by a reference numeral 13 is a second transfer roller, which is kept pressed against the roller 8*a* with the presence of the belt 8 between the two rollers 13 and 8*a*. The interface between the belt 8 and roller 13 is the second transfer nip. Designated by reference characters 1Y, 1M, 1C, and 1K are the first to fourth image forming portions, respectively, and are on the bottom side of the belt loop, being in alignment in the direction parallel to the belt movement direction, with preset intervals. Each of the four image forming portions is an electrophotographic system of the laser-beam-exposure type. Each image forming portion has an electrophotographic photosensitive member 2 (which hereafter will be referred to as drum 2) as an image bearing member (medium on an which image is formed). The drum 2 is rotated in the clockwise direction, that is, the direction indicated by an arrow mark, at a preset speed. Each image forming portion has a first charging device 3, a developing apparatus 4, a first transfer roller 5, and a drum cleaning apparatus 6, which are arranged in the adjacencies of the peripheral surface of the drum 2, in the listed order, in a manner to surround the drum 2. The drum 2, the first charging device 3, the developing apparatus 4, and the drum cleaner of each image forming portion are integrated in the form of a cartridge (process cartridge), so that they can be mounted together into, or removed together from, the main assembly of the printer 100. Each of the rollers 5 is on inward side of the loop which the belt 8 forms. It is kept pressed against the drum 2, with the presence of the portion of the belt, which corresponds in position to the bottom side of the belt loop, between the drum 2 and roller 5. The interface between the drum 2 and belt 8 is the first transfer nip. Designated by a reference character 7 is a laser-based exposing apparatus for exposing the drum 2 of each of the image forming portions. The exposing apparatus 7 is made up of: a light emitting means which emits a beam of laser light while modulating the beam with the information of the image to be formed, which is in the form of a sequence of electrical digital signals; a polygon mirror, a deflection mirror; etc.

The full-color image forming operation of the printer 100 is as follows. The image forming operation is started after the information to be set by a user, such as the image data, the size of the sheet of the recording medium for the image formation, the number of copies to be made, etc., is transferred to the control circuit 300 from the apparatus 500 and/or control panel 400. The control circuit 300 makes the image forming portions 1Y, 1M, 1C, and 1K form four monochromatic images, different in color, one for one, based on the four sets of information, which are obtained by the color separation of an original (source) image and are inputted to the control circuit 300 from the apparatus 500. Consequently, yellow (Y), magenta (M), cyan (C), and black (K) toner images are formed on the peripheral surface of the four drums 2, one for one. Since the principle of the electrophotographic process for forming a toner image on the drum 2 is well-known, it will not be described here. As four monochromatic color images are formed on the peripheral surface of the drums 2 of the four image forming portions, they are sequentially transferred (first transfer) in layers onto the outward surface (with reference to belt loop) of the belt 8, which is being moved in the same direction as the rotational direction of each drum 2 at a speed which corresponds to the rotational speed of each drum 2, in the first transfer nip, by a preset first transfer bias applied to each roller 5 with a preset timing. Thus, an unfixed full-color toner image is synthetically formed on the belt 8 by the layering of the four monochromatic toner images, different in color (Y, M, C, and K), on the belt 8. Meanwhile, the control circuit 300 receives recording-medium-size selection signals from the apparatus 500, or the recording-medium-size inputting means 600 (FIG. 3(*b*)) of the control panel 400, and feeds one or more sheets of the recording medium, which match in size to the recording-medium-size selection signals, into the main assembly of the printer 100. More concretely, the main assembly of the printer 100 has vertically stacked multiple (three) chambers 9A, 9B, and 9C for multiple recording medium feeder cassettes, one for one, in which three stacks of recording media, different in size and the material, are stored one for one. The control circuit 300 drives the pickup roller 10 of the recording medium feeder cassette chamber in which the recording medium sheet feeder cassette, which contains the recording medium sheets, the size of which matches the recording-medium-size selection signals. Thus, one of the layered sheets S of the recording medium of the selected size in the cassette is separated from the rest, and is conveyed to the pair of registration rollers 12 through the recording-sheet-conveyance vertical passage 11. The pair of registration roller 12 conveys the sheet S of the recording medium (which hereafter will be referred to simply as the recording sheet S) to the second transfer portion with such a timing that the recording sheet S reaches the second transfer nip at the same time that the leading edge of the full-color toner image on the circularly moving belt 8 reaches the second transfer nip. To the roller 13, the second transfer bias is applied with a reset timing, whereby the four monochromatic toner images on the belt 8, which make up the full-color toner image, are transferred all at once (second transfer) onto the surface of the recording sheet S. Then, the recording sheet S is separated from the surface of the belt 8, and guided by the vertical sheet guide 14 into the fixing apparatus 200, which is an image heating apparatus. Then, the abovementioned multiple monochromatic toner images, different in color, on the recording sheet S are mixed while being melted, and then, become fixed to the recording sheet S. Then, the recording sheet S is discharged from the apparatus 200, conveyed by way of the pair of exit rollers 15 of the fixing apparatus 200 and the recording-medium conveyance path 16, and discharged, as a full-color copy, into the delivery tray 18 by the pair of discharge rollers 17. Incidentally, when the printer 100 is in the black-and-white mode, only the fourth image forming portion 1K, that is, the portion for forming black toner images, is operated by the control circuit 300.

<Fixing Apparatus>

Figure 1B:
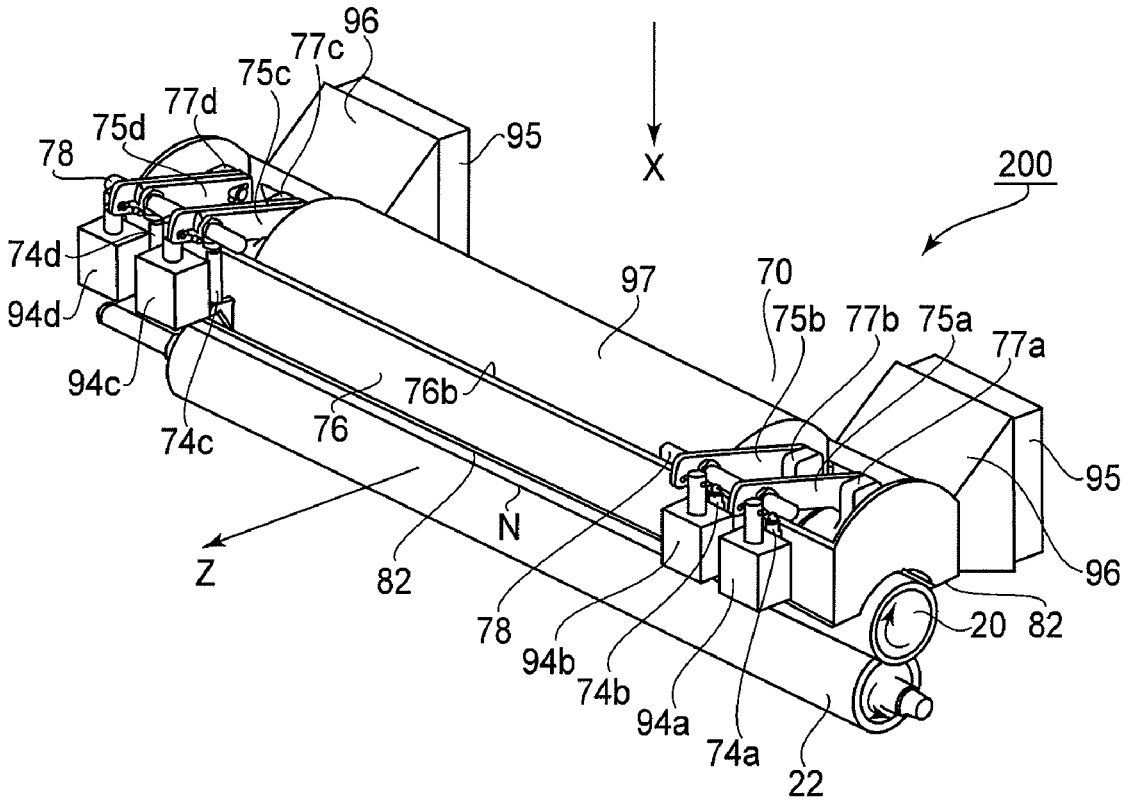
FIG. 1B is a perspective view of the fixing apparatus of the image forming apparatus shown in FIG. 1A, as seen from the rear side (recording medium exit side) of the fixing apparatus.
Figure 2:
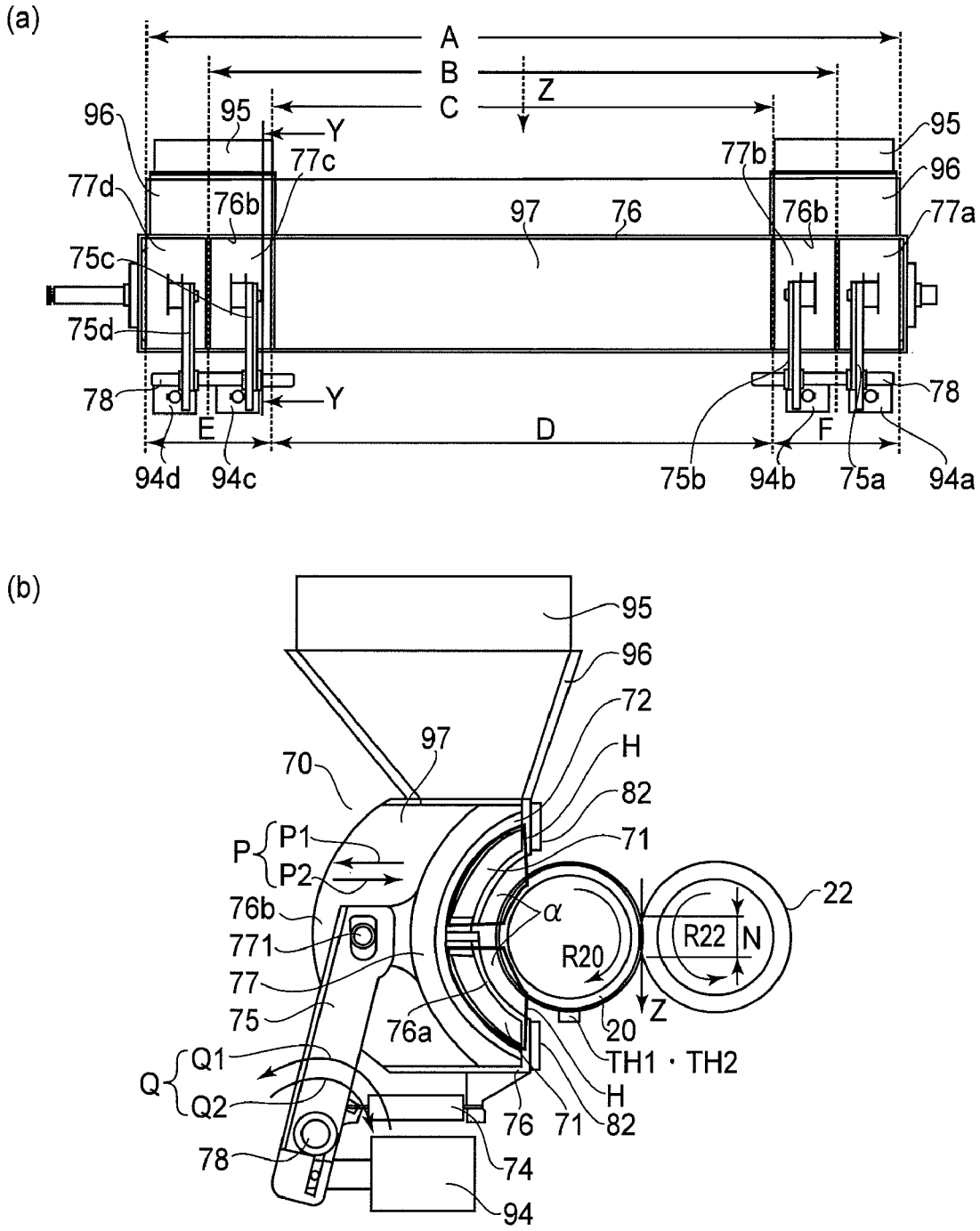
FIG. 2(*a*) is a plan view of the fixing apparatus shown in FIG. 1B, as seen from the direction indicated by an arrow mark X.
Figure 3:
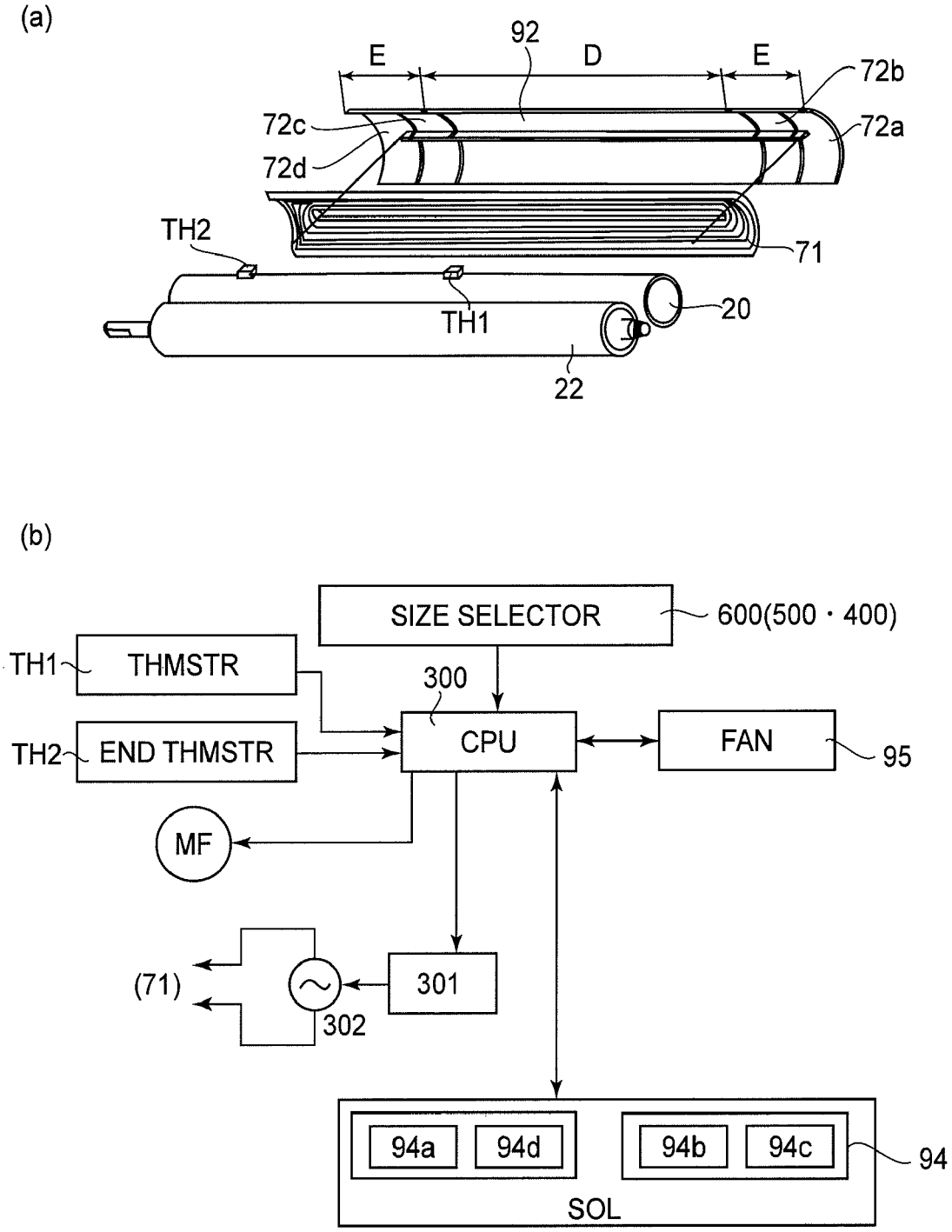
FIG. 3(*a*) is an exploded view of the essential portion of the fixing apparatus, and shows the fixation roller, the pressure roller, the exciter coil, and the exciter core.

The "front surface" of the fixing apparatus 200 is the surfaces of the fixing apparatus 200, which is on the recording medium entrance side of the apparatus 200, and the "rear surface" of the apparatus 200 is the surface of the apparatus 200 that is the opposite surface (recording, medium exit side) of the apparatus 200 from the "front surface". Further, the "front" surface of a given component which makes up the fixing apparatus 200 is the surface of the component, which is the front surface of the component as seen from the recording-medium entrance side, and the "rear surface" of the given component is the opposite surface of the given component from the "front surface". Further, the "left and right" of the fixing apparatus 200 are the left and right of the apparatus 200 as seen from the "front side" of the apparatus 200. Further, the "lengthwise direction" of the fixing apparatus 200 is the direction parallel to the axial line of any of the rotational members of the fixing apparatus 200, or the direction perpendicular to the direction in which the recording sheet S is conveyed on the recording-medium-conveyance-passage surface. Further, the "widthwise direction" means the direction perpendicular to the lengthwise direction. The "upstream and downstream sides" are the upstream and downstream sides in terms of the recording-medium conveyance direction. Moreover, the recording-sheet size (paper width) or the recording medium path width, means the measurement of the recording sheet S (width) in terms of the direction perpendicular to the recording-medium conveyance direction. FIG. 1B is a perspective view of the fixing apparatus 200, as seen from the rear side (recording-medium exit side) of the fixing apparatus 200. FIG. 2(*a*) is a plan view of the fixing apparatus 200, as seen from the direction indicated by an arrow mark X in FIG. 1B. FIG. 2(*b*) is an enlarged sectional view of the fixing apparatus 200, at a plane Y-Y in FIG. 2(*a*). FIG. 3(*a*) is an exploded view of the essential portions of the fixing apparatus 200, and shows the fixation roller, the pressure roller, the exciter coil, and the exciter core. FIG. 3(*b*) is a block diagram of the control system of the apparatus 200. Indicated by an arrow mark Z in FIG. 1B is the direction in which the recording sheet S is conveyed. The fixing apparatus 200 is an image heating apparatus of the electromagnetic-induction type. It has an image heating member in which heat is generated by magnetic flux, and a magnetic flux generating means. It is of the external-heat-source type. In other words, the magnetic flux generating means of this apparatus 200 is outside the image heating member. The fixing apparatus 200 has: a fixation roller 20 as an image heating member; a pressure roller 22 which is a rotatable pressure roller applying member; and a magnetic flux generation unit 70 as a magnetic flux generating means. It has also a fan 95 and an air duct 96, which make up the air blowing means (fan or blower) for blowing air (cooling air) to the adjacencies of the out-of-sheet-path portions of the apparatus 200. The roller 20 is such an image heating member that generates heat by electromagnetic induction. That is, it generates heat as it is subjected to the magnetic flux generated by the unit 70. It is rotatably supported by the left and right walls of the apparatus frame (unshown), with the interposition of a pair of bearings between the roller 20 and the left and right walls, one for one. The amount of magnetic flux generated by the unit 70 that is confined in the metallic portion of the roller 20 can be increased by using a highly magnetic metal (metal which is high permeability), such as iron, as the material for the metallic portion of the roller 20. In other words, heat can be efficiently generated in the roller 20 by generating an eddy current in the surface layer of the metallic portion of the roller 20 by increasing the magnetic flux density of the metallic portion. The roller 20 in this embodiment is primarily a metallic roller as an image heating member. It comprises: a metallic roller; an elastic layer on the peripheral surface of the metallic roller; and a parting layer (surface layer) on the elastic layer. The pressure roller 22 also is rotatably supported by the left and right walls of the apparatus frame, with the presence of a bearing between the pressure roller 22 and each wall. The pressure roller 22 is an elastic roller made by covering the entirety of the peripheral surface of a metallic core with an elastic layer. The rollers 20 and 22 are parallel to each other, and are kept pressed upon each other by a preset amount of pressure applied to the two rollers by a pressure applying means (unshown) so that a preset amount of contact pressure is maintained between the two rollers against the elasticity of the elastic layers of the two rollers. Thus, a nip N (fixation nip), which is preset in width in terms of the recording-medium conveyance direction, is maintained between the rollers 20 and 22. The unit 70 is on the opposite side of the fixation roller 20 from the pressure roller 22. It is between the left and right walls of the apparatus frame, and is solidly attached to the left and right walls of the apparatus frame, by the corresponding lengthwise ends. The unit 70 is parallel to the fixation roller 20, with the presence of a preset amount of gap a between the unit 70 and fixation roller 20. The unit 70 comprises: a housing 76 (casing), the lengthwise direction of which coincides with the lengthwise direction of the fixation roller 20; an exciter coil 71, magnetic cores 72 (which is made up of sections 72*a*, 72*b*, 73*c*, and 72*d*), 92, 82; etc. The exciter coil 17 and magnetic cores 72, 92, 82, etc., are attached to the housing 76.

The control circuit 300 begins driving a fixation motor MF with a preset timing in response to an image-formation start signal inputted from the host apparatus 500 or the control panel 400. The driving force from the motor MF is transmitted to the fixation roller 20 and/or pressure roller 22 by way of a driving force transmitting system, whereby the two rollers 20 and 22 are rotated in the directions indicated by arrow marks R20 and R22, respectively, in FIG. 2(*b*) at a preset speed. Further, the control circuit 300 turns on the excitation circuit 301 (a circuit for generating magnetic flux to generate heat in the heating member by magnetic induction; high frequency converter), whereby high frequency current flows through the coil 71 from an AC power source 302. Thus, the metallic base (electrically conductive core) of the roller 20 is increased in temperature by the heat generated therein by the eddy current induced in the magnetic field generated by the coil 71. That is, the coil 71 is made to generate an alternating magnetic flux by the alternating current supplied by the exciter circuit 301. The alternating magnetic flux is guided by the cores 72, 92, and 82 to the metallic base of the fixation roller 20, generating thereby an eddy current in the metallic base. The eddy current generates Joule heat because of the presence of the specific resistivity of the metallic core. In other words, as the coil 71 is supplied with the alternating current, the fixation roller 20, which is the image heating member, is heated by the eddy current induced in the metallic base of the roller 20 by the magnetic flux generated by the alternating current. Then, the surface temperature of the fixation roller 20 is detected by a sheet-path thermistor TH1 (temperature detecting first means). The electrical information regarding the detected temperature, which is outputted from the thermistor TH1, is inputted into the control circuit 300 by way of an A/D converter. The control circuit 300 controls the exciter circuit 301, based on the information outputted regarding the detected temperature of the fixation roller 20 by the thermistor TH1, so that the temperature of the fixation roller 20 is increased to a target level (fixation level), and is maintained at the target level. That is, the control circuit 300 controls the electric power supplied to the coil 71 from the electrical power source 302. As described above, the rollers 20 and 22 are rotated while the above-described controls are executed. As the temperature of the fixation roller 20 reaches the preset level (fixation level), the circuit 300 controls the exciter circuit 301 so that the temperature of the fixation roller 20 remains at the fixation level. While the temperature of the fixation roller 20 is kept at the fixation level, the recording sheet S on which the unfixed toner image is present is introduced into the aforementioned nip N, with the toner image bearing surface of the recording sheet S facing the fixation roller 20. Then, the recording sheet S is conveyed through the nip N, remaining pinched by the rollers 20 and 22 so that its toner image bearing surface remains in contact with the peripheral surface of the fixation roller 20. Thus, the heat of the fixation roller 20 is applied to the recording sheet S while being subjected to the nip pressure. Therefore, the unfixed image on the recording sheet S is fixed to the surface of the recording sheet S by the heat and pressure applied thereto.

Next, the structure of the unit 70 is described. The housing 76 is molded of heat resistant resin. It is long and narrow, and its lengthwise direction coincides with the left-and-right direction of the fixing apparatus 200. The bottom plate 76*a* of the housing 76 faces the fixation roller 20. The bottom plate 76*a* has such a curvature that its long edge portions are on the inward side of the housing 76 relative to the center portion of the housing 76, and also, that the bottom plate 76*a* covers virtually half the peripheral surface of the roller 20 in terms of the rotational direction of the fixation roller 20, with the presence of a uniform gap between the bottom plate 76*a* and fixation roller 20. The housing 76 has an opening 76*b* which is on the opposite side from the bottom plate 76*a*. The bottom plate 76*a* of the housing 76 is solidly attached to the left and right walls of the apparatus frame (unshown) by its left and right edges, by the solidly attaching means, with the presence of a preset gap a between the bottom plate 76*a* and the peripheral surface of the fixation roller 20. Referring to FIG. 3(*a*), the coil 71 is roughly ecliptically wound so that its lengthwise direction coincides with the lengthwise direction of the housing 76, and is given such a curvature that matches the curvature of the inward surface of the bottom plate 76*a* of the housing, which has such a curvature that its long edges are on the inward side of the bottom plate 72*a* relative to the center portion of the bottom plate 76*a*. As the wire for the coil 71, a Ritz wire, formed by bundling roughly 80 to 160 pieces of fine wires which are 0.1 to 0.3 mm in diameter, is used. The fine wires are coated with dielectric a substance. Further, the Ritz wire is wound eight to twelve times around the cores 72 and 92 to form the coil 71. The coil 71 is in connection with the exciter circuit 301 so that the coil 71 can be supplied with alternating current. The cores 72 and 92 are in alignment with each other in the lengthwise direction of the roller 20. Further, the core 72 is made up of multiple sections (72*a*, 72*b*, 72*c*, and 72*d*) which are in alignment with each other also in the lengthwise direction of the roller 20, that is, the direction perpendicular to the recording-medium conveyance direction Z. The cores 72 and 92 are shaped so that they surround their center portions, around which the coil 71 is wound, and the adjacencies of the center portions. At least one section of the core 72 is movable between its first position which faces the coil 71, and its second position which is away from the coil 71, by a core-section moving means, which will be described later. In this embodiment, the core 72 corresponds in position to ranges E of the recording-medium passage, that is, the fringe areas of the recording-medium passage, in terms of the direction perpendicular to the recording-medium conveyance direction. It is the core 72 that is movable within the housing 76 by the core-section moving mechanism, which will be described later. The core 92 corresponds in position to a range D, which is the center portion of the recording medium passage. The core 92 is solidly attached to the inward side of the housing 76. The image forming apparatus 100 and its fixing apparatus 200 in this embodiment are usable with various sheets of the recording sheets S, which are different in width. They are structured so that the recording sheet S is conveyed through them in such a manner that the center of the recording sheet S in terms of the widthwise direction remains aligned with the center of the recording-medium passage (center alignment). Referring to FIG. 2(*a*), "A" stands for the width of the widest recording medium (in terms of the widthwise direction) usable with (conveyable through) the apparatuses 100 and 200, and "C" stands for the width of the width of the smallest (narrowest) recording medium (in terms of the widthwise direction) usable with (conveyable through) the apparatuses 100 and 200. "B" stands for the width of the recording medium, which is between "A" and "B" in size in terms of the widthwise direction. The range D, which corresponds in position to the core 92, corresponds to the smallest sheet width C. The range which includes the range D and its adjacencies (range which corresponds in position to sections 72*b* and 72*c* of core 72), corresponds to medium sheet width B. The range which includes ranges D and E, that is, the range which corresponds to the combination of the core 9, sections 72*a*, 72*b*, 72*c*, and 72*d* of core 72, corresponds to the largest sheet width A. The cores 82 are on the outward side of the bottom plate 76*a* of the housing 76, and are solidly attached to the upstream and downstream sides, one for one, of the bottom plate 76*a*, in terms of the recording-medium conveyance direction. They extend in the lengthwise direction of the housing 76 across the range which corresponds to the ranges D and E. The cores 72, 92, and 82 play the role of efficiently guiding the alternating magnetic flux generated by the coil 71 to the metallic portion of the roller 20. That is, they are used to improve the magnetic circuit in efficiency, and also, to block the magnetism. The material for the cores 72, 92, and 82 are desired to be such a substance as ferrite that is high in permeability and low in residual magnetic flux density. The sheet-path thermistor TH1 detects the temperature of the portion of the fixation roller which corresponds in position to the range D. The periphery thermistor TH2 detects the temperature of the portion of the fixation roller, which corresponds in position to the range E. In this embodiment, the thermistor TH2 detects the temperature of the fixation roller, which corresponds in position to the section 72*d* of the core 72.

Next, the mechanism for moving the movable core 72 is described about its structure. The core 72 comprises four sections 72*a*, 72*b*, 72*c*, and 72*d*, which are individually moved away from, or toward, the coil 71, in the lengthwise direction, in the housing 76. Each of the sections 72*a*, 72*b*, 72*c*, and 72*d* of the core 72 is held by the core holder 77 (77*a*, 77*b*, 77*c*, and 77*d*); they are welded to the core holder 77. Further, they remain in the housing 76. The holder 77 is movable in the direction to change the gap between the core 72 and coil 71, that is, the direction indicated by an arrow mark P. Incidentally, the fixing apparatus 200 in this embodiment is provided with the holder 77. However, the provision of the holder 77 is not mandatory. That is, instead of the provision of the holder 77, the core 72 may be shaped in the form of a combination of the core 72 and holder 77. Each linkage 75 (75*a*, 75*b*, 75*c*, and 75*d*) is provided with an elongated hole, in which the projection 771 (connective projection) of the corresponding holder 77 fits so that the linkage 75 is allowed to rotate about the shaft 78. Therefore, as the linkage 75 is rotated in the direction indicated by an arrow mark Q1, the holder 77 and the core 72 move in the direction indicated by an arrow mark P1, which is the direction to cause the core 72 to move away from the coil 71. On the other hand, as the linkage 75 is rotated in the direction indicated by an arrow mark Q2, the holder 77 and the core 72 move in the direction indicated by an arrow mark P2, which is the direction to cause the core 72 to move toward the coil 71. In other words, the provision of the linkage 75 makes it possible to extend the distance by which the holder 77 and core 72 can be moved. Each linkage 75 (75*a*, 75*b*, 75*c*, and 75*d*) is connected to the corresponding solenoid 94 (94*a*, 94*b*, 94*c*, and 94*d*) so that it can be rotated in the direction indicated by the arrow mark Q1 by the mechanical force from the solenoid. Further, the linkage 75 is in contact with a pressure applying member 74 (74*a*, 74*b*, 74*c*, and 74*d*), being thereby kept pressed toward the direction indicated by the arrow mark Q2. The pressure applying member 74 is supported by the housing 76, by one of its lengthwise ends. When the fixing apparatus 200 is in the state shown in FIG. 2(*b*), the solenoid is not in action (solenoid is off), and therefore, the linkage 75 is in the farthest position into which it is movable in terms of the direction indicated by the arrow mark Q2 by the pressure applying member 74. When the linkage 75 is in the state shown in FIG. 2(*b*), the core 72 is in its first position, that is, the position in which it is closest to the coil 71, being a preset distance away from the coil 71. When the fixing apparatus 200 is in the state shown in FIG. 4B, the solenoid is in the activated state (solenoid is on), and therefore, the linkage 75 is in its farthest position into which it is rotatable in terms of the direction Q1 by the solenoid against the force from the pressure applying member 74. When the core 72 is in the state shown in FIG. 4B, it is in its second position, that is, the position which is a preset distance away in the direction Q1 from the first position. Designated by a reference numeral 97 is a hood which covers the opposite side of the core 92 from the coil 71. The hood 97 prevents the cooling air, which will be described later, from reaching the core 92 (range D). Designated by a reference character H in FIGS. 2(*b*) and 4B is a magnetic circuit (theoretical line) formed by the core 72 and roller 20 (image heating member) in the adjacencies of the coil 71.

Figure 4A:
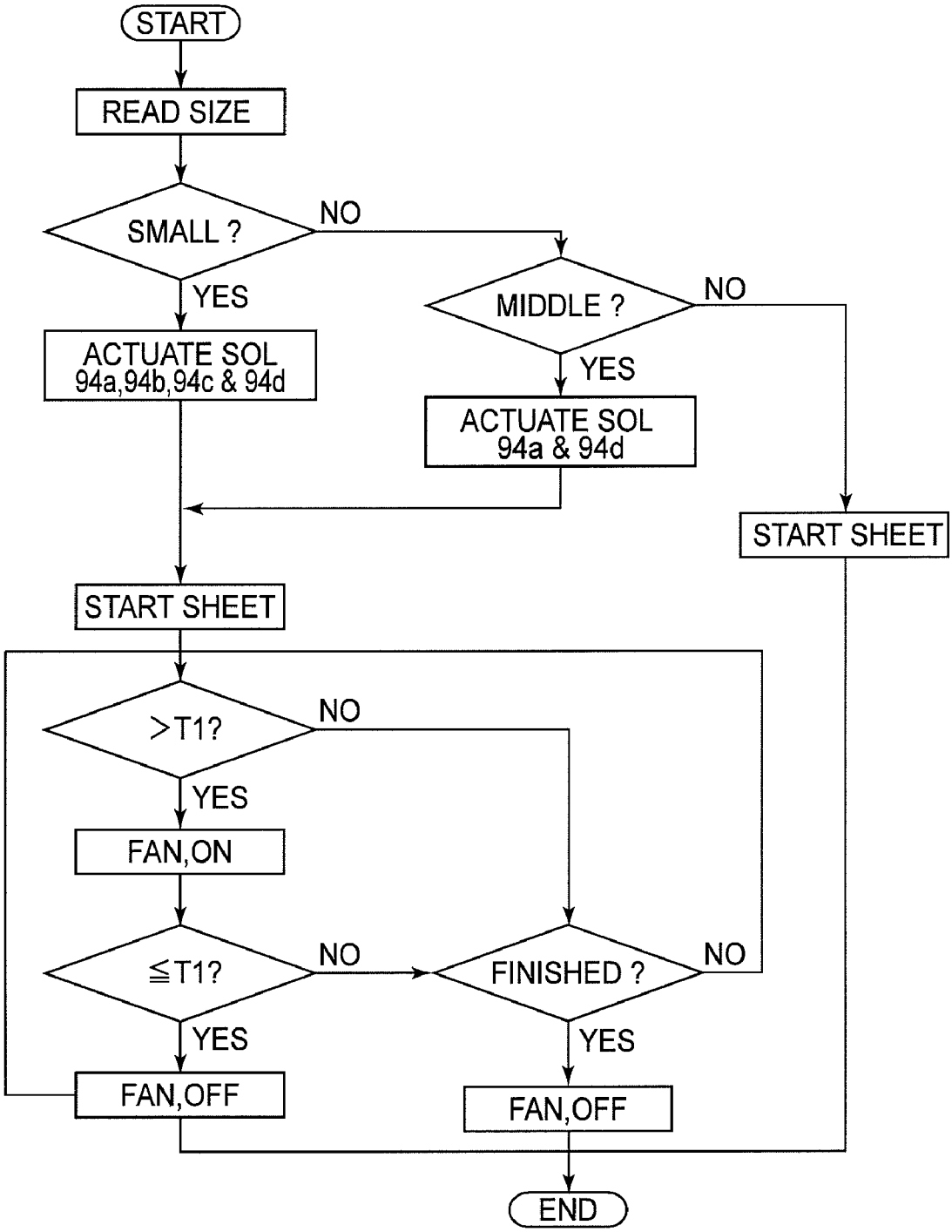
FIG. 4A is a flowchart of the operation for moving the sections of core.

Designated by a reference numeral 95 is a fan for blowing air into the out-of-sheet-path ranges (ranges E). The fan 95 is connected to the housing 75 through the air duct 96. Next, the core moving mechanism and the fan 95 are described. The circuit 300 reads the electrical signals sent from the apparatus 500 and/or the control panel 400 of the image forming apparatus 100, and controls the solenoid 94 (94*a*, 94*b*, 94*c*, and 94*d*) based on the information provided in the form of the electrical signals. The circuit 300 reads also the electrical signals from the periphery thermistor TH2, and controls the fan 95 based on the information delivered in the form of the electrical signals. Next, referring to the flowchart in FIG. 4A, the flow of the core moving operation is described. As a job is started, the circuit 300 reads the value inputted from the recording-sheet-size inputting means 600 to determine the size of the recording medium to be used for the job. If the recording sheet S to be used for the job is of the small size, the circuit 300 activates all the solenoids 94 (94*a*, 94*b*, 94*c*, and 94*d*). Thus, all of the sections 72*a*, 72*b*, 72*c*, and 72*d* of the core 72 are moved from their first positions shown in FIG. 2(*b*) into their second positions shown in FIG. 4B, creating thereby spaces K between themselves and coil 71, and are kept in the second positions, one for one. If the recording medium to be used for the job is of the medium size, the circuit 300 activates the solenoids 94*a* and 94*d*, whereby the sections 72*a* and 72*d* of the core 72 are moved from their first position shown in FIG. 2(*b*) into their second positions shown in FIG. 4B, creating thereby spaces K between themselves and coil 71, and are kept in the second positions, one for one. The solenoids 94*b* and 94*c* are not activated (solenoids are off), and therefore, the sections 72*b* and 72*c* of the core 72 remain in their first positions shown in FIG. 2(*b*), creating no space (K) between themselves and coil 71. Further, if the recording medium to be used for the job is of the large size, the circuit 300 activates none of the solenoids 94*a*, 94*b*, 94*c*, and 94*d*. Thus, all of the sections 72*a*, 72*b*, 72*c*, and 72*d* of the core 72 remain in their first positions shown in FIG. 2(*b*), creating no space (K) between themselves and coil 71. As the operation for moving the sections of the core 7 according to the width of the recording medium to be used for the job is ended, the recording-medium feeding operation is started. If the recording medium is of the small size or medium size, and the temperature level detected by the peripheral thermistor TH2 exceeds a preset level T1, the circuit 300 turns on the fan 95. Then, as the temperature level detected by the peripheral thermistor TH2 falls below the preset level T1, the circuit 300 turns off the fan 95. While the recording sheet S is conveyed through the fixing apparatus 200, the circuit 300 repeats the above-described sequence to keep the surface temperature of the lengthwise end portions (out-of-sheet-path portion) of the roller 20 below the preset level T1. On the other hand, if the recording medium to be used for the job is of the large size, it does not occur that the out-of-sheet-path portions of the roller 20 excessively increase in temperature, and therefore, the circuit 300 does not activate the fan 95 until the recording-medium conveyance is ended.

Figure 4B:
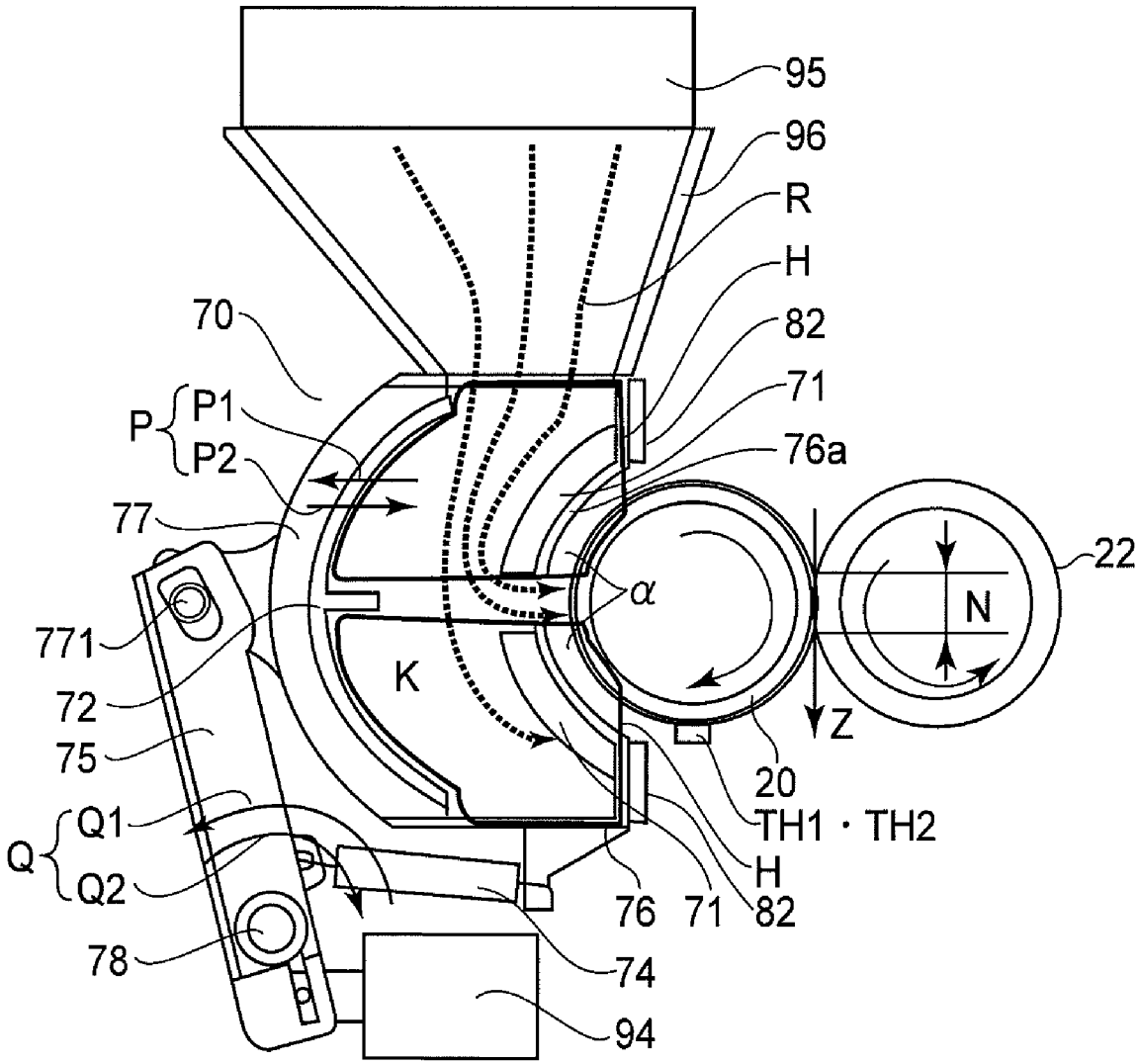
FIG. 4B is a schematic sectional view of the image heating apparatus when the movable portions of the core are in their second position.

FIG. 4B is a schematic sectional view of the image heating apparatus after the circuit 300 recognized from the signals from the recording-sheet-size inputting means 600 that the recording medium to be used for the job is of the small size, and the sections of the core 72, which correspond in position to the ranges E, that is, the out-of-sheet-path portions of the core 72, have been moved. As the circuit 300 recognizes that the recording medium to be used for the job is of the small size, it rotates the linkages 75*a*-75*d* about the axis 78 by activating the solenoids 94*a*-94*d*, respectively. Thus, the holders 77*a*-77*d* are moved in the direction P1, causing the sections 72*a*-72*d* of the core 72 to move from their first positions to their second positions, creating gaps between the sections 72*a*-72*d* and coil 71. That is, the spaces K are formed between the sections 72*a*-72*d* of the core 72 and the coil 71. Therefore, while the core 72 is in the second position, the magnetic circuit H formed around the coil 71 of the core 72 and the roller 20 (image heating member) is lower in fixation efficiency, and therefore, smaller (effect A) in the amount of heat it generates than when the core 72 is in the first position as shown in FIG. 2(*b*). Further, air is blown by the air blowing means 95 and 96, into the space K, which was formed between the core 72 and coil 71 by the movement of the core 72. That is, the fixing apparatus 200 is structured so that the air flow R generated by the fan 95 is blown onto the out-of-sheet path portions (portions which correspond in position to ranges E) of the fixation roller 20 through an air passage comprising the duct 96→housing 76→gap of coil 71. That is, air is blown onto the portions of the roller 20, which correspond in position to the out-of-sheet-path (ranges E) of the recording-medium passage, by the abovementioned air blowing means 95, thereby cooling these portions of the fixation roller 20. Since the out-of-sheet-path portions of the fixation roller 20 are cooled, they are prevented from excessively increasing in temperature (benefit effect B). In other words, the image forming apparatus 100 and the fixing apparatus 200 in this embodiment benefit from both the effects A and B, and therefore, it is superior in the prevention of the excessive increase in the temperature of the out-of-sheet-path portions of the fixation roller 20 to a combination of an image forming apparatus and fixing apparatus in accordance with any of the prior art. When the recording sheet S to be conveyed through the fixing apparatus 200 is of the medium size, the sections 72*a* and 72*d* of the core 72 are moved from their first positions to their second positions, and therefore, the out-of-sheet-path portions of the fixation roller 20, which correspond in position to the sections 72*a* and 72*d* of the core 72 benefit from the effects A and B. Therefore, also in this case, the image forming apparatus 100 and the fixing apparatus 200 in this embodiment are superior in the prevention of the excessive increases in the temperature of the out-of-sheet-path portions of the fixation roller 20 to a combination of an image forming apparatus and a fixing apparatus in accordance to any of the prior art. Further, in the case of the fixing apparatus 200 in this embodiment, it is only the core 72 that has to be moved. Therefore, not only is it simpler in general structure, but also, is smaller in spatial requirement. Further, the movement of the core 72 from its first position to its second position exposes the coil 71 to the path of the airflow R. In other words, the movement enables the airflow R to blow upon the coil 71 as well. That is, the movement allows the airflow R to blow upon the portions of the coil 71 that correspond in position to the above-described spaces K. Therefore, the phenomenon that the coil 71 increases in temperature because of its heat generation loss is prevented (minimized).

Embodiment 2

Figure 5:
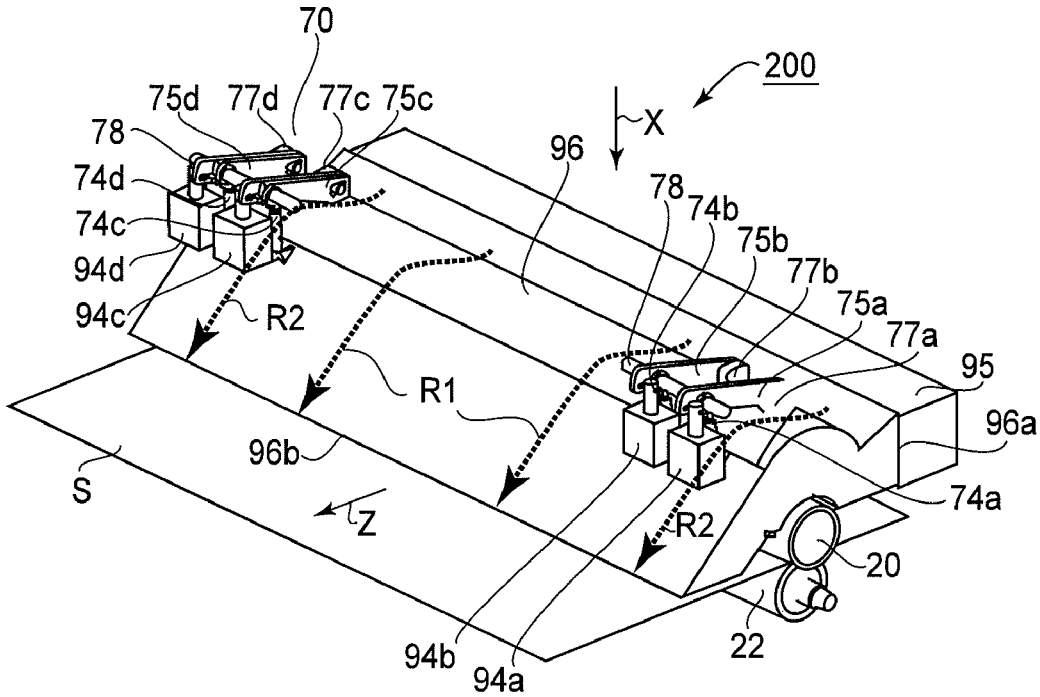
FIG. 5(*a*) is a perspective view of the fixing apparatus in the second preferred embodiment of the present invention, as seen from the rear side (recording medium exit side) of the apparatus.
Figure 5:
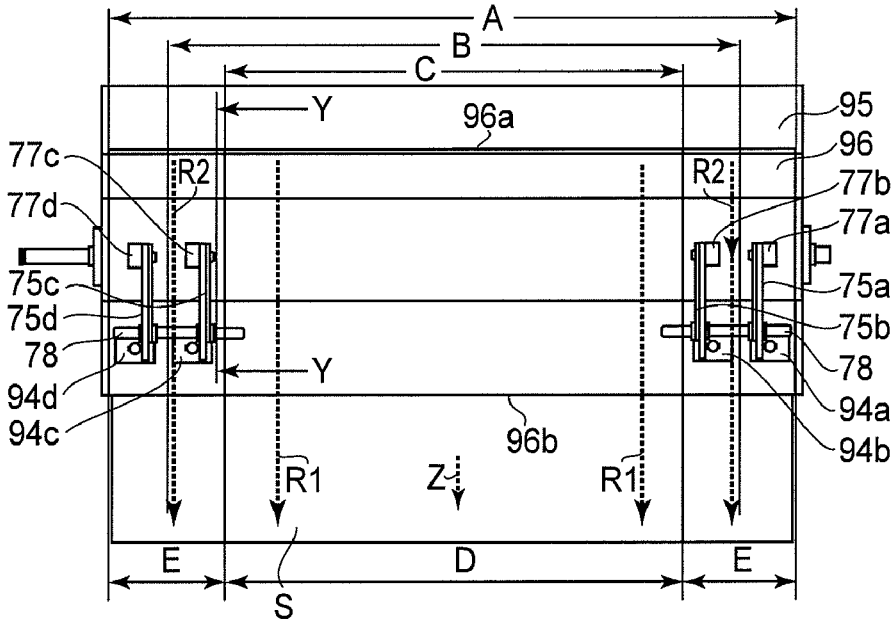
Figure 6:
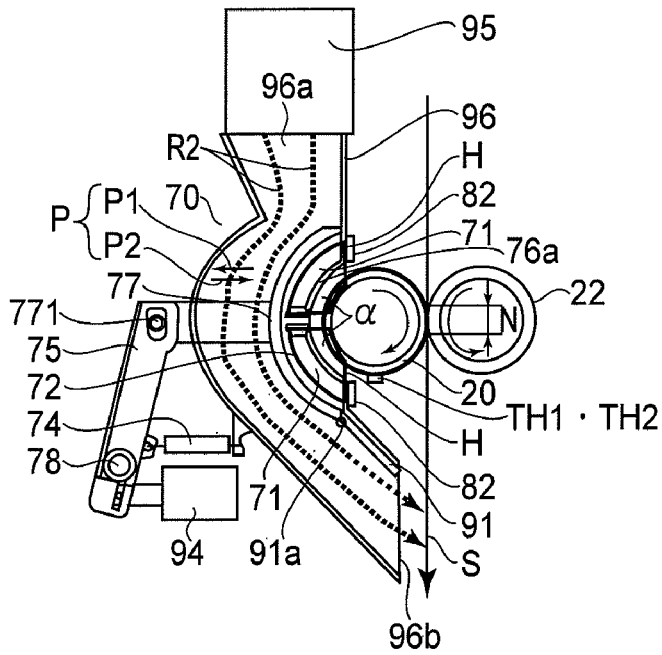
FIG. 6(*a*) is an enlarged schematic sectional view of the apparatus shown in FIG. 5(*a*), at a plane Y-Y in FIG. 5(*a*).
Figure 6:
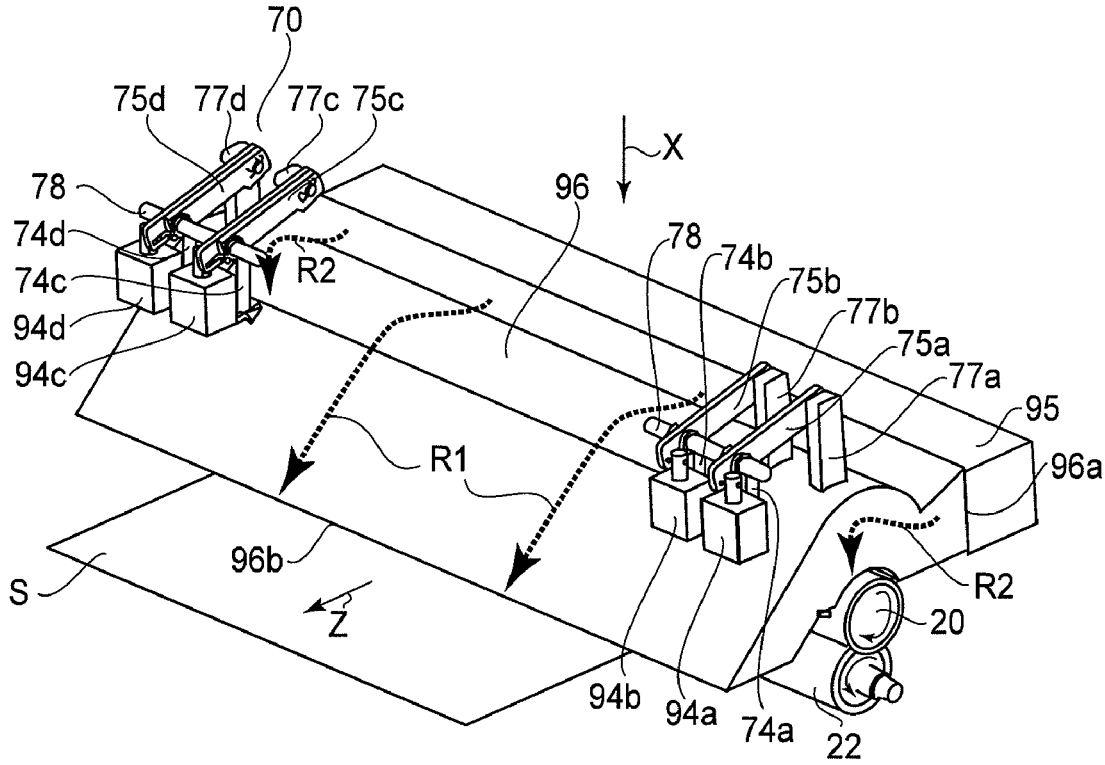

FIG. 5(*a*) is a perspective view of the fixing apparatus (as image heating apparatus) in the second preferred embodiment of the present invention, as seen from the rear side (recording medium exit side) of the apparatus. FIG. 5(*b*) is a plan view of the fixing apparatus in FIG. 5(*a*), as seen from the direction indicated by an arrow mark X in FIG. 5(*a*). FIG. 6(*a*) is a sectional view of the apparatus shown in FIG. 5(*a*), at a plane Y-Y in FIG. 5(*a*). In the case of the fixing apparatus 200 in this embodiment, its housing 76 of the magnetic flux generation unit 70 (first embodiment) doubles as the duct 96 of the air blowing means 95 and 96. That is, the coil 71, the core 72 (sections 72*a*-72*d*), and the core 92 are in the duct 96, whereas the cores 82 are outside the duct 96. The fixing apparatus 200 is also provided with a holder 77 (77*a*-77*d*), linkages 75 (75*a*-75*d*), a shaft 78, solenoids 94 (94*a*-94*d*), and pressure applying members 74 (74*a*-74*d*), which make up the core moving means similar in structure to the core moving means in the first embodiment. The duct 96 is long enough to extend from one end of the combination of the range D and ranges E to the other. The inlet opening 96*a* of the duct 96 is on the upstream side of the fixation roller 20 in terms of the recording-medium conveyance direction. The fan 95 is at the inlet end 96*a* of the duct 96. The outlet 96*b* of the duct 96, which is at the opposite end of the duct 96 from the inlet end 96*a*, is shaped so that the airflow is aimed at the downstream portion of the recording-medium conveyance passage, relative to the fixation roller 20, in terms of the recording-medium conveyance direction. The outlet end 96*b* of the duct 96 is wide enough to cover both the range D and ranges E. The fixing apparatus 200 in this embodiment is provided with shutter plates 91, which are the same in width as the holders 77 of the sections 72*a*, 72*b*, 72*c*, and 72*d* of the movable core 72. The shutter plates 91 are held to the downstream end of the holders 77 in terms of the recording-medium conveyance direction, by their rotational axes 91*a*, one for one.

The cooling operation of the fixing apparatus 200 in this embodiment is as follows. As soon as the conveyance of the recording sheet S through the fixing apparatus 200 begins, the fan 95 is turned on (air blowing operation is started), whereas as soon as the recording-medium conveyance ends, the fan 95 is turned off (airflow is stopped). That is, the fan 95 is always kept on while the recording sheet S is conveyed through the fixing apparatus 200. Prior to the starting of the recording-medium conveyance through the fixing apparatus 200, the solenoids 94 (94*a*-94*d*) are kept turned off. Therefore, the sections 72*a*, 72*b*, 72*c*, and 72*d* of the movable core 72 are all kept in their first positions. As a printing job is started, the circuit 300 reads the recording-sheet-size value inputted from the recording-sheet-size inputting means 600. When the recording sheet S to be used for the job is of the large size, the circuit 300 starts the job while keeping all the solenoids 94*a*, 94*b*, 94*c*, and 94*d* turned off. The fan 95 is turned on as soon as the job is started. FIGS. 5(*a*) and 6(*a*) show the states of the fixing apparatus 200 in the second embodiment when a large sheet of recording medium is being conveyed through the fixing apparatuses 200. In these cases, as the external air is introduced into the duct 96 by the fan 95, the portion of the airflow that corresponds in position to the range D flows on the outward side of the core 92 in the direction indicated by an arrow mark R1, and reaches the outlet 96*b*, whereas the portions of the airflow, which correspond in position to the ranges E, flow on the outward side of the holders 77 (77*a*-77*d*) of the core 72 (72*a*-72*d*), respectively, in the direction indicated by an arrow mark R2, and reach the air outlet opening 96*b*. Thus, the airflow portions R1 and R2 do not function as the airflow for directly cooling the roller 20 and coil 71. After coming out of the duct 96 through the air outlet opening 96*b*, the airflows R1 and R2 flow toward the portion of the recording sheet S, which is coming out of the nip N. That is, when the movable core 72 is in its first position, the air blowing means 95 and 96 cause air to flow toward the downstream side of the recording-medium conveyance passage, relative to the roller 20, in terms of the recording-medium-conveyance direction, whereby the portion of the recording sheet S that has just been moved through the nip N, being therefore hot, is cooled. Therefore, the image forming apparatus is prevented from become excessively high in internal temperature.

Figure 7:
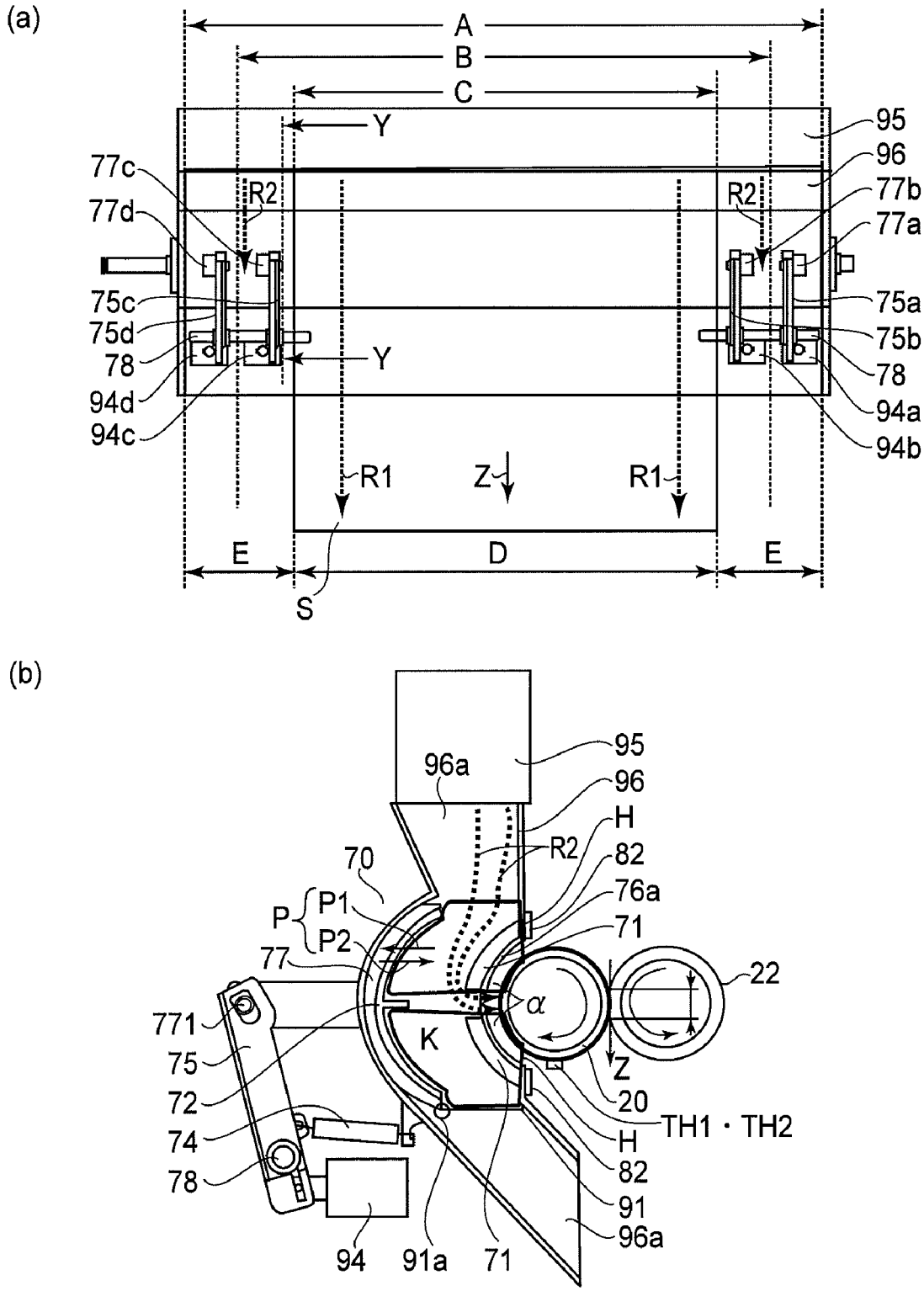
FIG. 7(*a*) is a plan view of the fixing apparatus in FIG. 6(*b*) as seen from the direction indicated by an arrow mark X.
Figure 8:
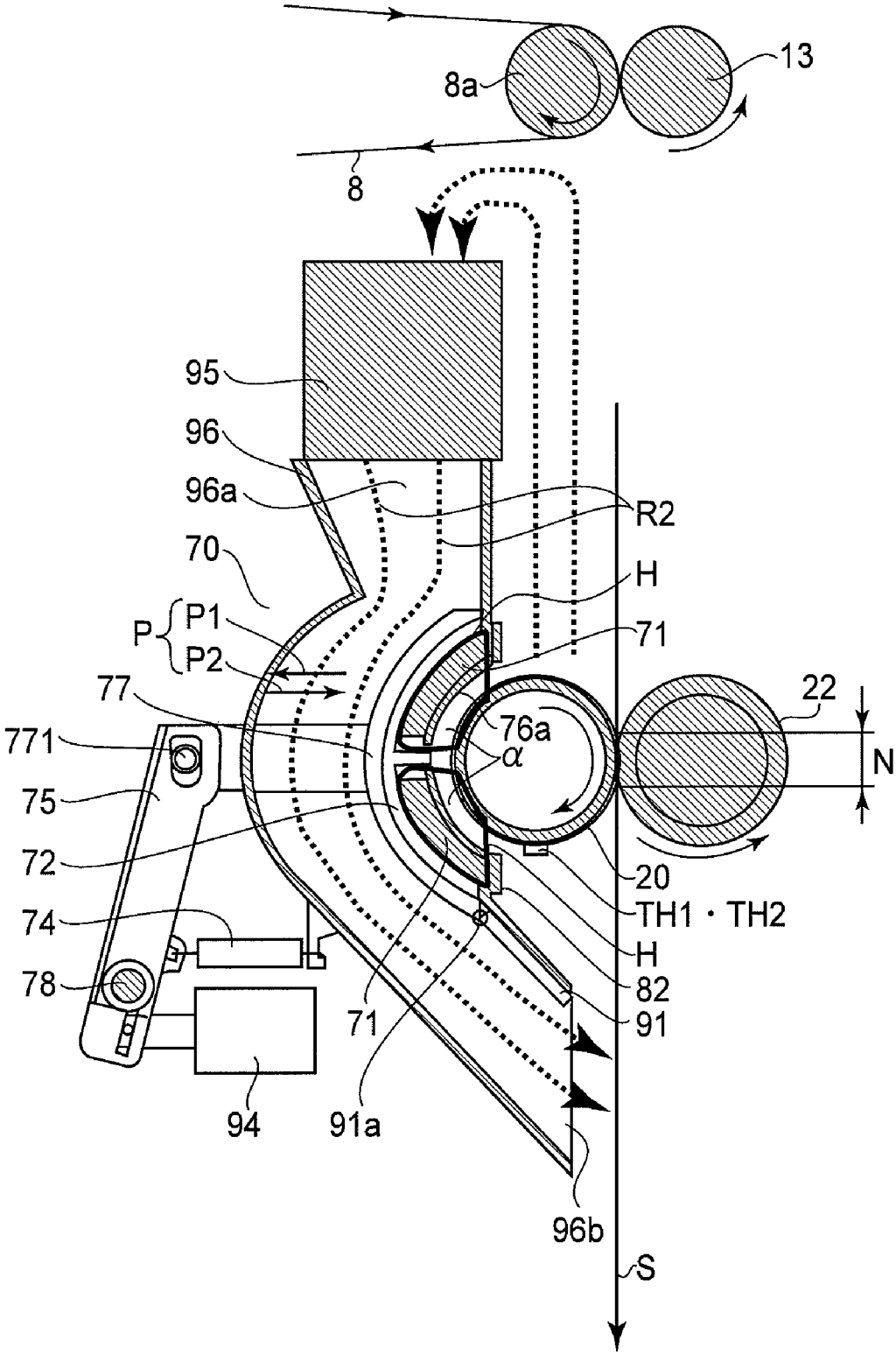
FIG. 8 is a schematic sectional view of the air blowing means, and shows how the external air of the fixing apparatus is sucked into the apparatus by the air blowing means.

When the recording medium to be used for the job is of the small size, the circuit 300 turns on all the solenoids 94*a*, 94*b*, 94*c*, and 94*d*, whereby the sections 72*a*, 72*b*, 72*c*, and 72*d* of the movable core 72 are moved from their first positions to their second positions, and retained therein. Then, the circuit 300 starts the image forming operation (job). The fan 95 is turned on as soon as the job is started. FIG. 6(*b*) and FIGS. 7(*a*) and 7(*b*) show the state of the fixing apparatus 200 when a recording sheet of the small size is being conveyed through the fixing apparatus 200. Referring to FIG. 7(*b*), when the core 72 (72*a*-72*d*) is in the second position, there is a space K between the core 72 (sections 72*a*-72*d*) and coil 71. Therefore, when the core 72 is in the second position, the magnetic circuit H formed around the coil 71, of the core 72 and fixation roller 20 (image heating member) as shown in FIG. 6(*a*), is lower in efficiency, being therefore lower in the amount of heat it generates (effect A), than when the core 72 is in the first position. Further, as the core 72 (sections 72*a*-72*d*) is moved from the first position to the second position, the shutter 91 is rotated about the shaft 92*a*, thereby closing the air outlet 96*b* side of the space K as shown in FIG. 7(*b*). That is, the shutter 91 controls the portions of the airflow in the duct 96 that correspond in position to the ranges E. In other words, the space K created by the movement of the core 72 is used to divide the airflow R generated by the fan 95 into the portion R1 that flows toward the range D (sheet-path area), and the portion R2 that flows toward the ranges E (out-of-sheet-path areas); the fixing apparatus 200 is structured so that the portion R2 of the airflow is blown upon the fixation roller 20 through the duct 96→gaps of the coil 71. Thus, in the ranges E, the out-of-sheet-path portions of the fixation roller 20 are cooled, being thereby prevented from excessively increasing in temperature (effect B). As described above, the image heating apparatus in this embodiment benefits from both the effects A and B. Therefore, it is superior in terms of the prevention of the excessive increase in the temperature of the out-of-sheet-path portions of the fixation roller 20 to a fixing apparatus in accordance with any of the prior arts. The portion of the airflow, which flows through the portion of the duct 96, which corresponds in position to the range D, can cool the portion of the recording sheet S (of small size) that has just come through the nip N, being therefore hot. Therefore, the image forming apparatus 100 is prevented from excessively increasing in internal temperature. When the recording sheet S to be used for the job is of the medium size, the sections 72*a* and 72*d* of the core 72 are moved from the first positions to the second positions, causing the out-of-sheet path portions of the fixation roller 20 to benefits from the effects A and B. In other words, the present invention is superior in terms of the prevention of the excessive increase in the temperature of the out-of-sheet-path portions of the fixation roller 20 to any of the prior arts. The portions of the airflow, which flow through the portions of the duct 96, which correspond in position to the range D and the portions 72*b* and 72*c* of the core 72, can cool the portion of the recording sheet S (of medium size), which has just come through the nip N, being therefor hot. Therefore, they can prevent the image forming apparatus 100 from excessively increase in internal temperature.

Further, it is only the core 72 that has to be moved. Therefore, not only is the fixing apparatus 200 in this embodiment simpler in general structure, but also, it is smaller in spatial requirement. Further, the movement of the core 72 can efficiently separate the airflow generated by the fan 95 into the portions R1 and R2, making it unnecessary to provide the fixing apparatus with a fan dedicated to the cooling of the recording sheet S, and therefore, making it possible to minimize the fixing apparatus in terms of the spatial requirements. The image forming apparatus 100 sometimes increases in temperature because a part of the body of air heated by the heat generated by the fixing apparatus 200 flows into the second transfer portion, which is on the upstream side of the fixing apparatus 200 in terms of the recording-medium conveyance direction. In this embodiment, however, as the portion of the body of air heated by the fixing apparatus 200 reaches the second transfer portion, it is sucked away by the fan 95 to prevent the image forming apparatus 100 from excessively increasing in internal temperature. In other words, the air blowing means 95 and 96 suck away the body of air on the upstream side of the roller 20 in terms of the recording-medium conveyance direction.

[Miscellanies]

1) The image heating member 20 and the pressure applying member 22 do not need to be in the form of a roller; they may be in the form of an endless belt.

2) The image heating member does not need to be rotatable; it may not be rotatable.

3) The magnetic flux generating means may be placed inside the image heating member 20 so that the image heating member is heated from within.

4) The image forming apparatus and fixing apparatus may be structured so that when a sheet of the recording medium is conveyed through the image forming apparatus and the fixing apparatus, one of the edges of the sheet of the recording medium, which is parallel to the recording medium conveyance direction, is kept aligned with the corresponding edge of the recording-medium conveyance passage of the apparatuses (lateral alignment).

5) The recording-sheet-size detecting means 600 may be positioned in the portion of the recording-medium conveyance passage, which is between the recording-medium feeding portion and the fixing apparatus 200.

6) Not only can an image forming apparatus in accordance with the present invention be used as a thermal image fixing apparatus, such as those in the preceding embodiments, but also, as an image heating apparatus for heating a sheet of the recording medium on which an image is present, to improve the image in surface properties, such as glossiness, an image heating apparatus for temporarily fixing an image, and an image heating apparatus for quickly drying the ink of which an image is formed by an image forming apparatus, such as an inkjet image forming apparatus, which uses liquid which contains dye or pigment, can be used.

7) It is needless to say that it is not only an electrophotographic process of the transfer type, but also, other processes, such as an electrostatic process, magnetic process, etc., that the present invention is compatible.

According to the present invention, an image forming apparatus and its fixing apparatus are structured so that air is blown onto the image heating member of the fixing apparatus through the space created by the movement of the magnetic core. Therefore, even if the image forming apparatus is increased in productivity, it is possible to reliably prevent the out-of-sheet-path portions of the image heating member from excessively increasing in temperature.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 222319/2009 filed Sep. 28, 2009 which is hereby incorporated by reference.

What is claimed is:

1. An image heating apparatus comprising:

an excitation coil;

an image heating member configured to heat an image on a recording material by heat generated by a magnetic flux of said excitation coil;

a core disposed opposed to said excitation coil;

moving means for moving said core between a first position in which said core is opposed to said excitation coil and a second position in which said core is more remote from said excitation coil than the first position; and an air blower configured to blow air into a space between said core and said excitation coil, the space being provided by moving said core to the second position.

2. An apparatus according to claim 1, wherein said core is disposed at a position corresponding to an end of said image heating member with respect to a direction perpendicular to a feeding direction of the recording material.

3. An apparatus according to claim 1, further comprising a second core provided at a position corresponding to a central portion of said image heating member with respect to a direction perpendicular to a feeding direction of the recording material.

4. An apparatus according to claim 1, wherein said air blower takes air from upstream of said image heating member with respect to a feeding direction of the recording material.

5. An apparatus according to claim 1, wherein said air blower blows air to a portion of a recording material feeding path which is downstream of said image heating member with respect to a feeding direction of the recording material, when said core is in the first position.

* * * * *